US007748181B1

(12) United States Patent
Guinn

(10) Patent No.: US 7,748,181 B1
(45) Date of Patent: Jul. 6, 2010

(54) ADVANCED BUILDING ENVELOPE DELIVERY SYSTEM AND METHOD

(75) Inventor: Richard A. Guinn, North Wales, PA (US)

(73) Assignee: Centria, Moon Township, PA (US)

( * ) Notice: Subject to any disclaimer, the term of this patent is extended or adjusted under 35 U.S.C. 154(b) by 437 days.

(21) Appl. No.: 11/654,181

(22) Filed: Jan. 17, 2007

Related U.S. Application Data

(60) Provisional application No. 60/760,804, filed on Jan. 20, 2006.

(51) Int. Cl.
*E04H 1/00* (2006.01)
*E04B 1/74* (2006.01)

(52) U.S. Cl. ..... 52/235; 52/309.9; 52/404.4; 52/404.2; 52/478; 52/506.05; 52/511; 52/592.1

(58) Field of Classification Search ..... 52/235, 52/408, 513, 378, 379, 592.1, 404.4, 404.2, 52/409, 410, 506.05, 592, 511
See application file for complete search history.

(56) References Cited

U.S. PATENT DOCUMENTS 3,427,775 A * 2/1969 Bachrich ..... 52/402
3,535,844 A * 10/1970 Glaros ..... 52/592.1
3,797,190 A * 3/1974 Widdowson ..... 52/592.4
4,021,990 A * 5/1977 Schwalberg ..... 52/479
4,037,377 A * 7/1977 Howell et al. ..... 52/309.9
4,100,710 A * 7/1978 Kowallik ..... 52/309.9
4,110,948 A * 9/1978 Maier, Jr. ..... 52/402
4,123,885 A * 11/1978 Scott ..... 52/489.1
4,184,301 A * 1/1980 Anderson et al. ..... 52/478
4,236,366 A * 12/1980 Rijnders ..... 52/580
4,292,781 A * 10/1981 Chalmers et al. ..... 52/547
4,304,083 A * 12/1981 Anderson ..... 52/509
4,596,102 A * 6/1986 Catani et al. ..... 52/508
4,610,120 A * 9/1986 Canavesi et al. ..... 52/511
4,685,263 A * 8/1987 Ting ..... 52/235
4,738,070 A * 4/1988 Abbott et al. ..... 52/710
4,765,107 A * 8/1988 Ting ..... 52/235
4,936,078 A * 6/1990 Porter ..... 52/592.1
4,955,172 A * 9/1990 Pierson ..... 52/710
4,970,842 A * 11/1990 Kappeler et al. ..... 52/74

(Continued)

OTHER PUBLICATIONS

Koreteck—Home Page (1 pg.) dated Nov. 4, 2005.

(Continued)

*Primary Examiner*—Robert J Canfield
*Assistant Examiner*—Babajide Demuren
(74) *Attorney, Agent, or Firm*—The Webb Law Firm

(57) ABSTRACT

A building envelope system for providing a continuous air, water, vapor and thermal barrier about a building structure is provided. The building envelope system includes framing structurally connected to the building structure and at least one barrier panel attached to an outer face of the framing and providing an air, water, vapor and thermal barrier about the building structure. The at least one barrier panel includes a structural foam core and inner and outer facing sheets provided about the structural foam core. The at least one barrier panel provides structural support for an exterior facade system. The exterior façade system is attachable to the outer facing sheet of the at least one barrier panel such that the air, water, vapor and thermal barrier defined by the at least one barrier panel is maintained.

14 Claims, 10 Drawing Sheets

U.S. PATENT DOCUMENTS

| | | | | | |
|---|---|---|---|---|---|
| 5,347,781 | A | * | 9/1994 | Hanlon | 52/379 |
| 5,425,210 | A | * | 6/1995 | Zafir | 52/404.4 |
| 5,473,851 | A | * | 12/1995 | Northrup, Jr. | 52/513 |
| 5,598,673 | A | * | 2/1997 | Atkins | 52/302.1 |
| 5,749,282 | A | * | 5/1998 | Brow et al. | 52/235 |
| 5,816,008 | A | * | 10/1998 | Hohmann | 52/565 |
| 5,875,592 | A | | 3/1999 | Allman et al. | |
| 6,000,178 | A | * | 12/1999 | Goodings | 52/235 |
| 6,212,841 | B1 | * | 4/2001 | Plume | 52/513 |
| 6,253,511 | B1 | | 7/2001 | Boyer | |
| 6,427,408 | B1 | * | 8/2002 | Krieger | 52/489.1 |
| 6,627,128 | B1 | | 9/2003 | Boyer | |
| 6,951,086 | B2 | * | 10/2005 | Passeno | 52/386 |
| 6,968,659 | B2 | * | 11/2005 | Boyer | 52/302.4 |
| 2004/0134143 | A1 | | 7/2004 | Boyer | |
| 2004/0216416 | A1 | * | 11/2004 | Hohmann et al. | 52/513 |
| 2005/0210800 | A1 | * | 9/2005 | Wobber | 52/506.1 |
| 2006/0272255 | A1 | * | 12/2006 | Honda | 52/506.05 |

OTHER PUBLICATIONS

Koreteck—Panelized Building System (22 pgs.) dated Nov. 4, 2005.
BASF—Walltite Insulating Air Barrier System (3 pgs.) dated Nov. 18, 2005.
BASF—Spray Applied Technologies (3 pgs.) dated Nov. 18, 2005.

* cited by examiner

ADVANCED BUILDING ENVELOPE DELIVERY SYSTEM AND METHOD

CROSS-REFERENCE TO RELATED APPLICATIONS

This application claims the benefit of provisional patent application Ser. No. 60/760,804 entitled "Advanced Building Envelope Delivery System and Method", filed on Jan. 20, 2006, the entire disclosure of which is incorporated by reference herein.

FIELD OF THE INVENTION

The present invention is directed toward a building envelope delivery system and method and, more particularly, toward a building envelope delivery system and method which integrates an optimized barrier wall with integrated structural subframing specifically optimized for a variety of exterior facade systems.

BACKGROUND OF THE INVENTION

One of the most important concerns in building envelope methodology is the air and water barrier located behind the exterior skin of the building. Since the exterior panel typically is a vented element, it generally has marginal performance rating as an air barrier and may even permit wind driven rain through its joinery. Thus, the interface of the air barrier element with the wall system perimeter and penetration trim and corner transitions must be carefully detailed and inspected, as well as the system drainage details.

The successful design of a rainscreen system relies heavily on the performance and installation of an air and water barrier. A properly designed exterior element of a good rainscreen wall system is one that will protect the air and water barrier and prevent most, if not all, of the water from entering the wall cavity from the exterior, while allowing the wall cavity to vent and drain any moisture that does enter. Moisture control within the wall cavity is an important concern in an effort to mitigate the potential for mold growth.

Current building envelope methodology requires multi-component systems to be used to achieve the thermal and moisture protection for the building interior. Present systems use such multi-component wall systems to achieve the barrier wall protection required with rainscreen panel system design. FIG. 1 illustrates such a traditional multi-component wall construction, shown generally at 10.

As shown in FIG. 1, the wall construction 10 includes wall framing 12 which is connected to the building structure 13 via a structural connection, shown at 14. A barrier element 16 is attached to the outer surface of the wall framing 12. Building wrap 18 is typically provided about the barrier element 16, with building insulation 20 applied over the building wrap 18. The barrier element 16, building wrap 18 and building insulation 20 of the wall construction 10 achieve the air, water, vapor and thermal barrier required with traditional rainscreen panel system designs. However, a problem with such traditional multi-component wall constructions is that the connectors, or tie-ins, for exterior facade panel systems typically need to penetrate the barrier formed by the multiple components in order to provide structural support for the exterior panels. As shown in FIG. 1, the exterior facade panel connector 22 extends through the barrier formed by the insulation 20, building wrap 18 and barrier element 16, and connects to the wall framing 12 to provide structural support for the exterior facade panels 24. This is because neither the insulation 20, the building wrap 18 nor the barrier element 16 are designed to provide structural support. Thus, in order to attach the exterior facade panel system 24 to the building, the air, water, vapor and thermal barrier of the traditional multi-component wall construction 10 must be compromised.

Additionally, during construction, the multi-component wall construction 10 can typically require multiple trades to execute the work. One group will put up the wall framing 12. Then another group may attach the barrier element 16. Yet another group may attach the building wrap 18. And still another group may attach the building insulation 20. Use of multiple trades during construction has the potential of becoming a trade coordination issue that can not only delay construction, but can complicate the identification of installation errors, thus resulting in system failure.

The present invention is directed toward overcoming one or more of the above-identified problems.

SUMMARY OF THE INVENTION

The present invention simplifies the complexity of the multi-component wall system with a single element that is structurally optimized with the wall framing system and specifically designed to accommodate the barrier wall as well as loadings from the exterior wall system. This combines the multi-component construction into a simple barrier wall panel that is supported by a structural wall framing system. The inventive system allows for multiple exterior panel (facade) options to complete the rainscreen panel system. This approach allows the functional performance of a wall system to be separated from the architectural appearance of the external panel.

The combination of barrier defenses (air, water, vapor and thermal) into one composite panel can significantly enhance the ability of the building envelope to perform properly. The use of a single barrier panel allows for the option of panelization of the system, therefore accelerating the process of building close-in, which may have significant impact on temporary heat requirements and the minimization of moisture intrusion into the building interior during the construction process. The external panel connections can be made to minimize the potential breach of the barrier wall (air, water, vapor and thermal).

It is an object of the present invention to provide a building envelope system and method having an easily achieved continuous barrier (air, water, vapor and thermal).

It is a further object of the present invention to provide a building envelope system and method of single interior panel construction and an outer rainscreen element.

It is yet a further object of the present invention to provide a building envelope system and method connectable to a variety of exterior architectural systems.

It is still a further object of the present invention to provide a building envelope system and method providing structural support for a variety of exterior architectural systems.

It is another object of the present invention to provide a building envelope system and method that can be panelized for easy installation.

Other objects, aspects and advantages of the present invention can be obtained from a study of the specification, the drawings, and the appended claims.

DETAILED DESCRIPTION OF THE INVENTION

Figure 2:
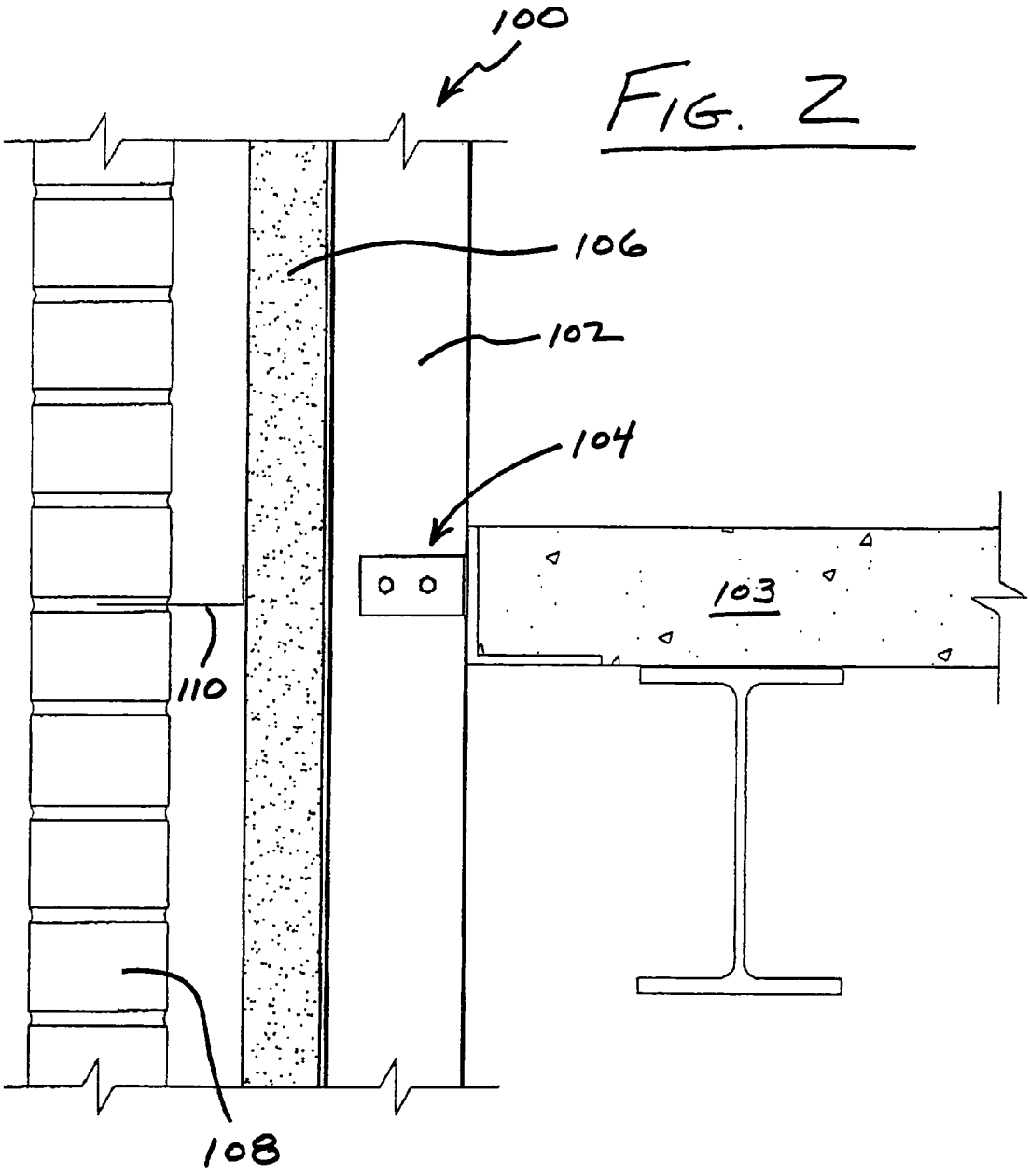
FIG. 2 illustrates a building envelope system in accordance with the present invention.

FIG. 2 illustrates a building envelope system, shown generally at 100, in accordance with the teachings of the present invention. The building envelope system 100 includes a metal stud support, or wall framing, 102 structurally connected to the building structure 103 via a structural connection at 104. A barrier panel 106 is attached to the outer face of the wall framing 102. The barrier panel 106 is a composite panel which provides an air, water, vapor and thermal barrier. An exterior panel system 108 is attached to the outer surface of the barrier panel 106 via an exterior panel connector piece 110.

Figure 1:
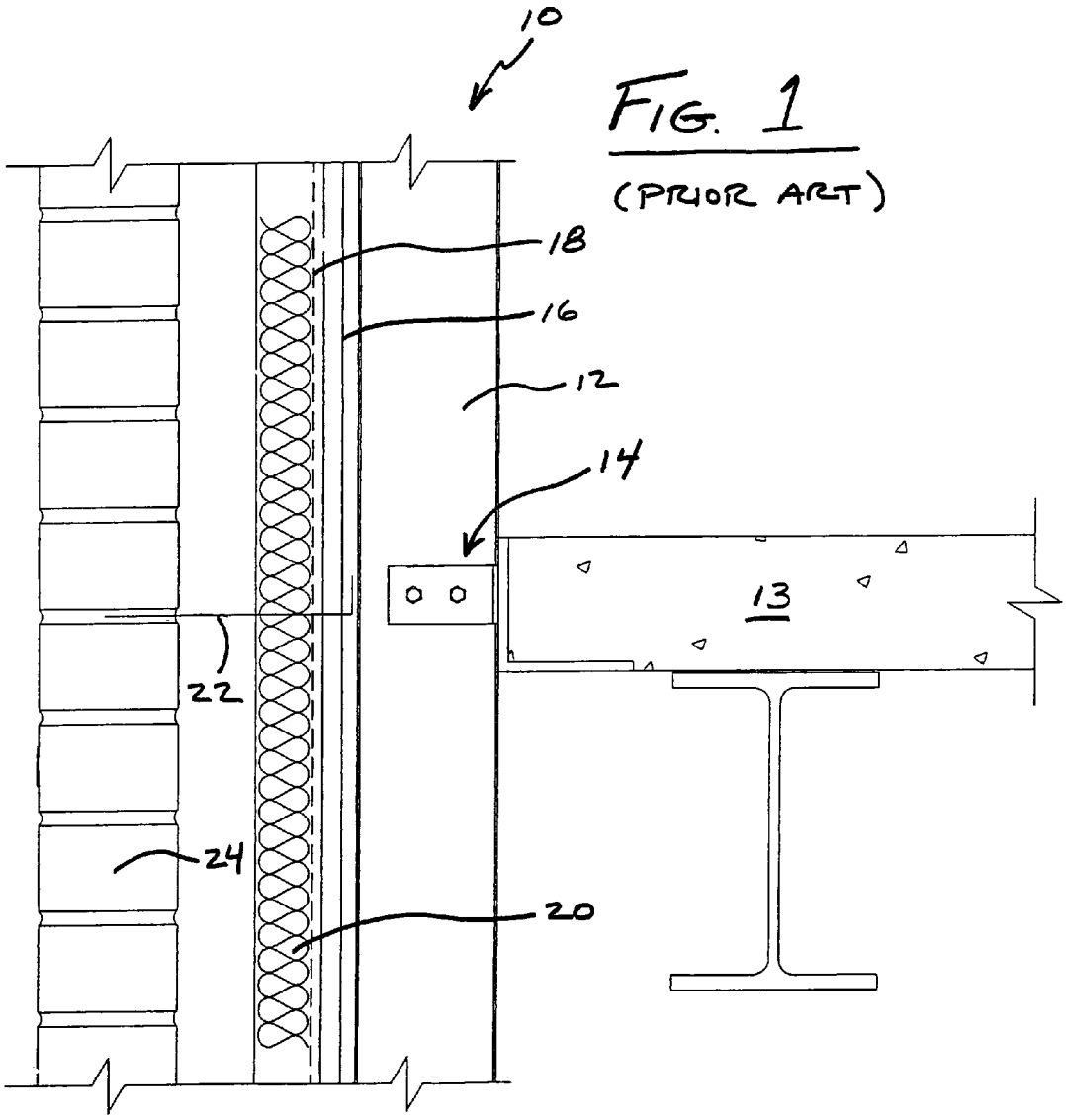
FIG. 1 (PRIOR ART)
FIG. 1 illustrates a traditional, multi-component wall construction system.

Unlike in the prior art wall construction shown in FIG. 1, the exterior panel connector piece 110 does not extend through the barrier panel 106, and thus does not penetrate the air, water, vapor and thermal barrier provided by the barrier panel 106. In addition to providing an air, water, vapor and thermal barrier, the panels 106 provide structural support for the exterior facade system 108, which means that the exterior panel connector ties 110 can attach to the barrier panel 106, rather than extending back through the barrier formed by the panels 106 to the wall framing 102. Therefore, the present invention is able to achieve a continuous air, water, vapor and thermal barrier defined by the barrier panels 106.

Figure 3:
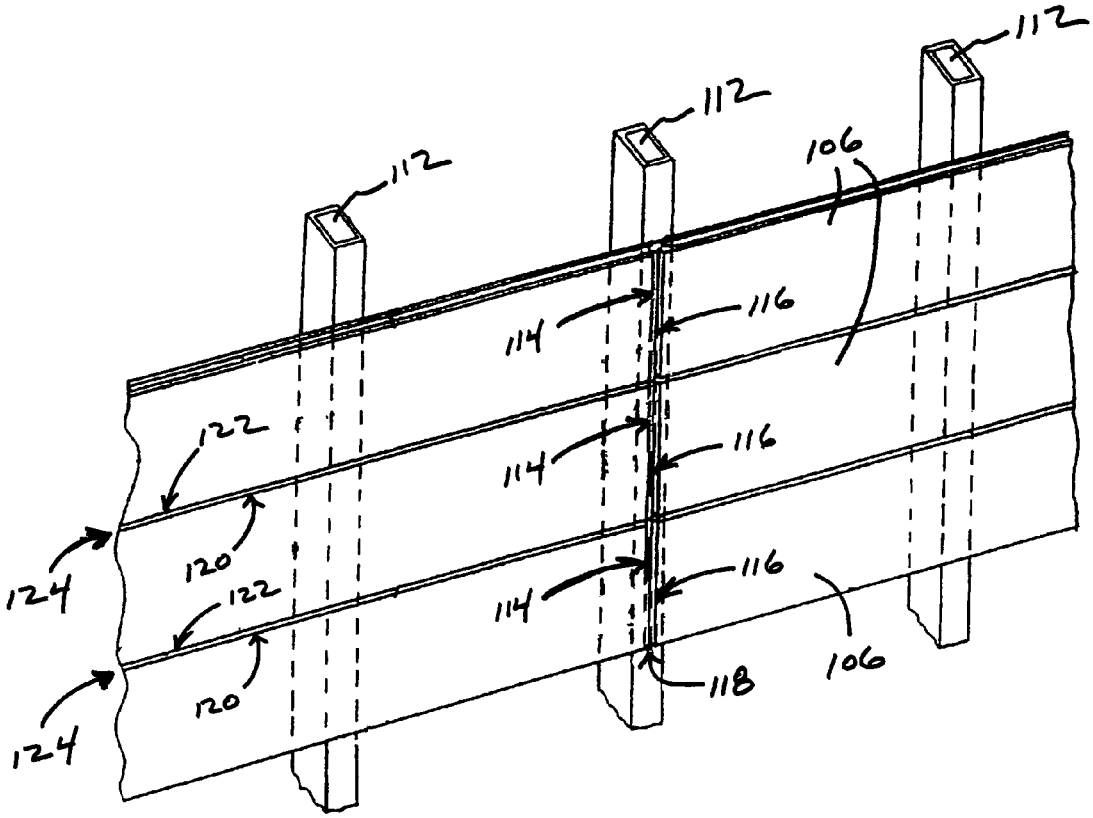
FIG. 3 is a perspective view of a building envelope system illustrating the connection of barrier panels in an exemplary horizontal joint configuration (in the embodiment where the system is rotated 90°, the illustrated horizontal joint becomes a vertical joint)

Referring to FIG. 3, the wall framing 102 typically includes vertical studs, or columns, 112 connected to the building structure (not shown in FIG. 3). The wall construction is assembled from individual barrier panels 106 having adjacent panel ends 114, 116 forming a vertical joint 118, and being connected along the upper and lower side edges 120, 122 to form a horizontal wall joint 124.

Figure 4:
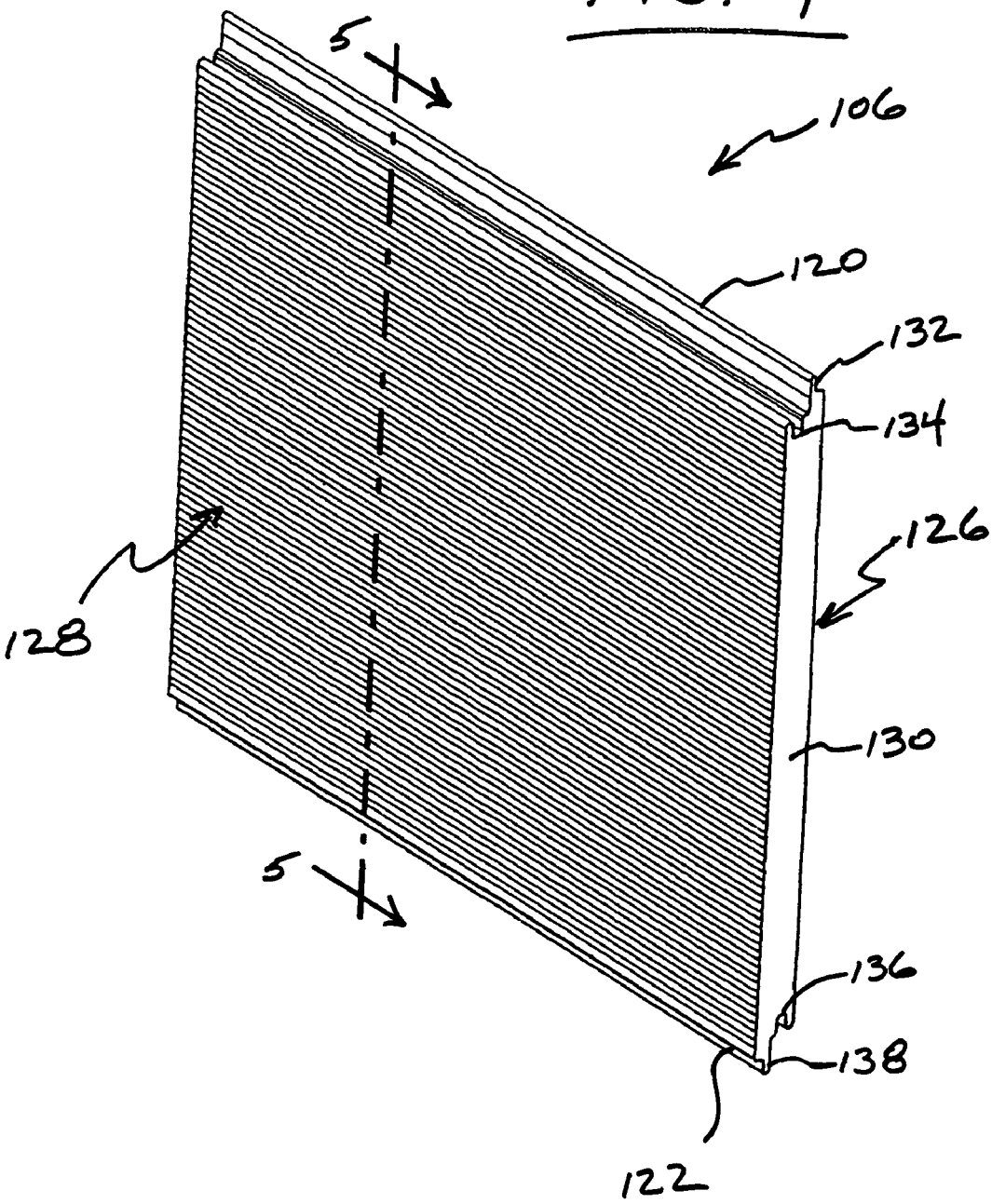
FIG. 4 is a perspective view illustrating a barrier panel in accordance with the present invention.
Figure 5:
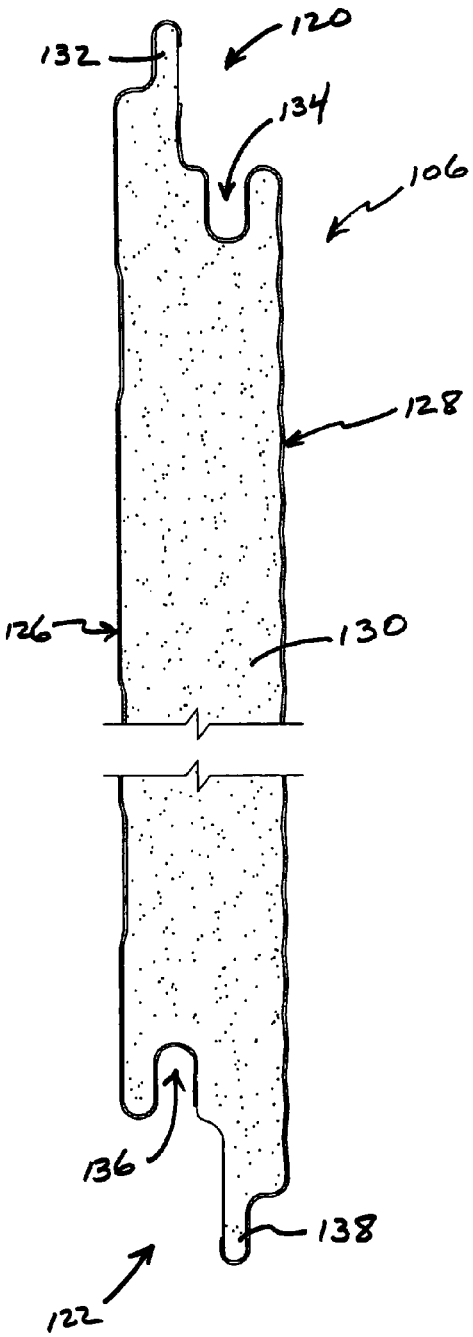
FIG. 5 is a cross-sectional view taken along line 5-5 in FIG. 4 illustrating a striated panel exterior surface.
Figure 6:
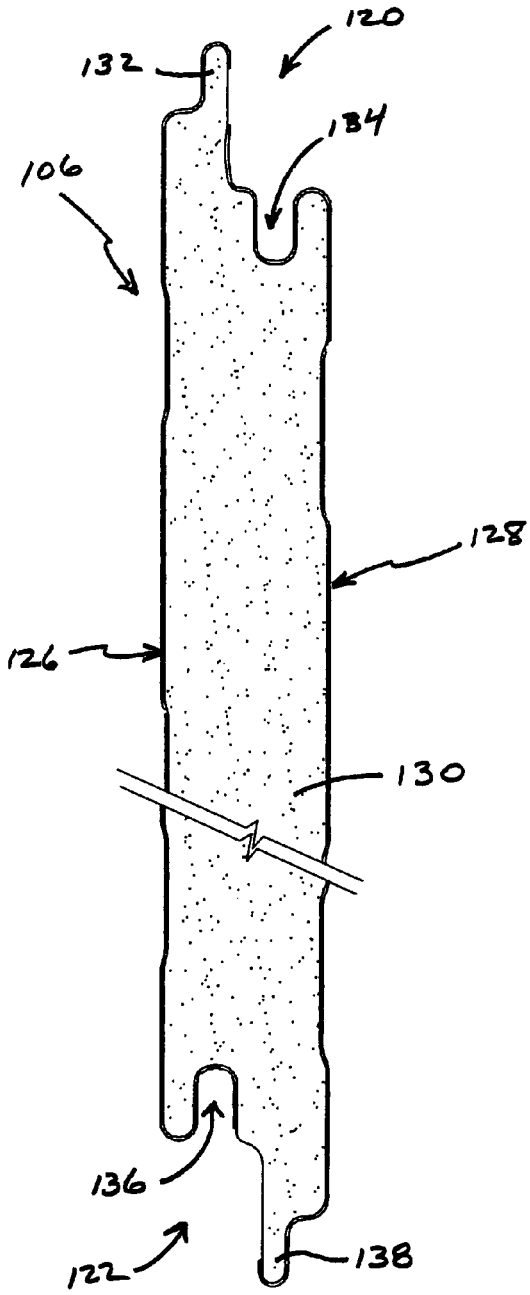
FIG. 6 is a cross-sectional view taken along line 5-5 in FIG. 4 illustrating a planked panel exterior surface.

Referring to FIGS. 4-7, the barrier panel 106 includes inner 126 and outer 128 facing sheets and a structural foam core 130 filling the interior space of the barrier panel 106 and adhesively connecting the facing sheets 126, 128 to provide a structural barrier panel 106. The structural foam core 130 may be provided between the inner 126 and outer 128 facing sheets by a variety of known means. In view of the bond provided between the structural foam core 130 and the facing sheets 126, 128, structural integrity and strength are greatly enhanced. While the outer facing sheet 128 is illustrated in FIGS. 4-5 as being striated, other textures, including a smooth texture (flat skin), planked texture (see FIG. 6), etc., are contemplated for the outer facing sheet 128 without departing from the spirit and scope of the present invention.

At the upper edge 120 of the barrier panel 106, the inner 126 and outer 128 facing sheets connect and provide an inner male connector, or tongue, 132 and an outer female connector 134. At the lower edge 122 of the barrier panel 106, the inner 126 and outer 128 facing sheets connect and provide an inner female connector 136 and an outer male connector, or tongue, 138. The female connectors 134, 136 are adapted to receive the tongues 138, 132, respectively, of a subadjacent barrier panel 106, as shown in FIG. 7.

Figure 7:
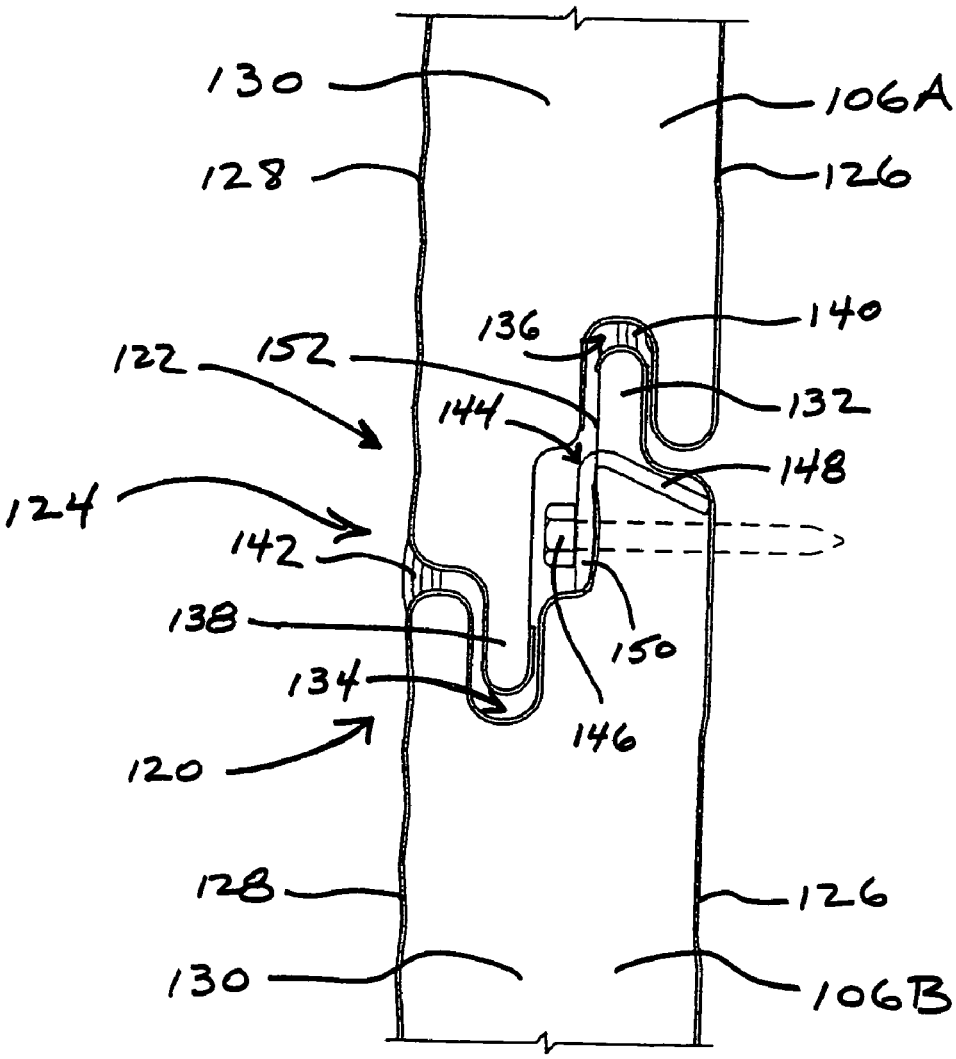
FIG. 7 illustrates an exemplary horizontal joint connection between top and bottom barrier panels, as well as connection of the barrier panels to the subframing (in the embodiment where the system is rotated 90°, the illustrated horizontal joint becomes a vertical joint)

As illustrated in FIG. 7, the inner female connector 136 typically receives a bead of sealant 140, such as a non-hardening butyl sealant. The bead of sealant 140 is adapted to be penetrated by the inner tongue 132 of a subadjacent barrier panel 106B to form an inner seal. A bead of sealant 142 is also provided at the horizontal joint 124 formed between subadjacent panels 106A, 106B to form an outer seal. While not shown in FIG. 7, the outer female connector 134 may also receive a bead of sealant adapted to be penetrated by the outer tongue 138 of a subadjacent panel 106A to further seal the horizontal joint 124.

FIG. 7 illustrates the horizontal joint 124 formed between upper and lower panels 106A, 106B. As shown in FIG. 7, a lower barrier panel 106B is secured at its upper edge 120 to the subframing 102 by a clip 144 and a fastener 146. The clip 144 includes a downturned central flange 148 penetrating the foam core 130, and a main flange portion 150 which overlies an upstanding side 152 of the upper edge 120 which forms part of the inner male connector 132. The fastener 146 extends through the main flange portion 150, the upstanding side 152, the foam core 130, the inner facing sheet 126, and into the wall framing 102. In this manner, both the inner 126 and outer 128 facing sheets of the panel 106B are secured to the wall framing 102. The upper panel 106A is maintained in position at its lower edge 122 via engagement of the outer male connector 138 with the outer female connector 134 of subadjacent panels 106A, 106B.

The foam core 130 is typically includes a polyurethane or poly-isocyanurate foam material having the following thermal properties: thickness from about 2.0 inches to about 2.75 inches; U (BTU/hour/sq.ft./° F.) from about 0.044 to about 0.069, and preferably from about 0.054 to about 0.069; and R (1/U) from about 14.4 to about 22.75, and preferably from about 14.4 to about 18.7. However, other types of foam core material, and combinations of materials, having thermal properties outside of the above ranges, as well as suitable structural, combustion and fire-resistant properties, may be utilized without departing from the spirit and scope of the present invention. For example, phenolic foam and mineral wool, and other similar materials and combinations thereof, may be utilized as the foam core material if desired.

The inner 126 and outer 128 facing sheets are typically made from G90 galvanized steel for structural strength purposes and to resist corrosion should moisture develop between the exterior facade system 108 and the barrier panels 106. However, other metallic materials, and combinations of materials, such as aluminum and other similar materials, are also contemplated for the inner 126 and outer 128 facing sheets. The combination of the foam core 130 surrounded by the inner 126 and outer 128 facing sheets (metal skins) allows the panels 106 to form the desired air, water, vapor and thermal barrier around the building.

The panels 106 are preferably 2 to 2¾ inches thick, 30 to 36 inches high, and 1 to 48 (more preferably 5 to 48) feet in length. However, other panel dimensions are also contemplated, and the dimensions herein recited are for illustrative purposes only and are not meant to limit the scope of the present invention. For example, the longer the lengths of the panels 106, the more continuous the barrier wall formed by the panels 106. The panel dimensions may be modified to suit particular applications without departing from the spirit and scope of the present invention.

Figure 8:
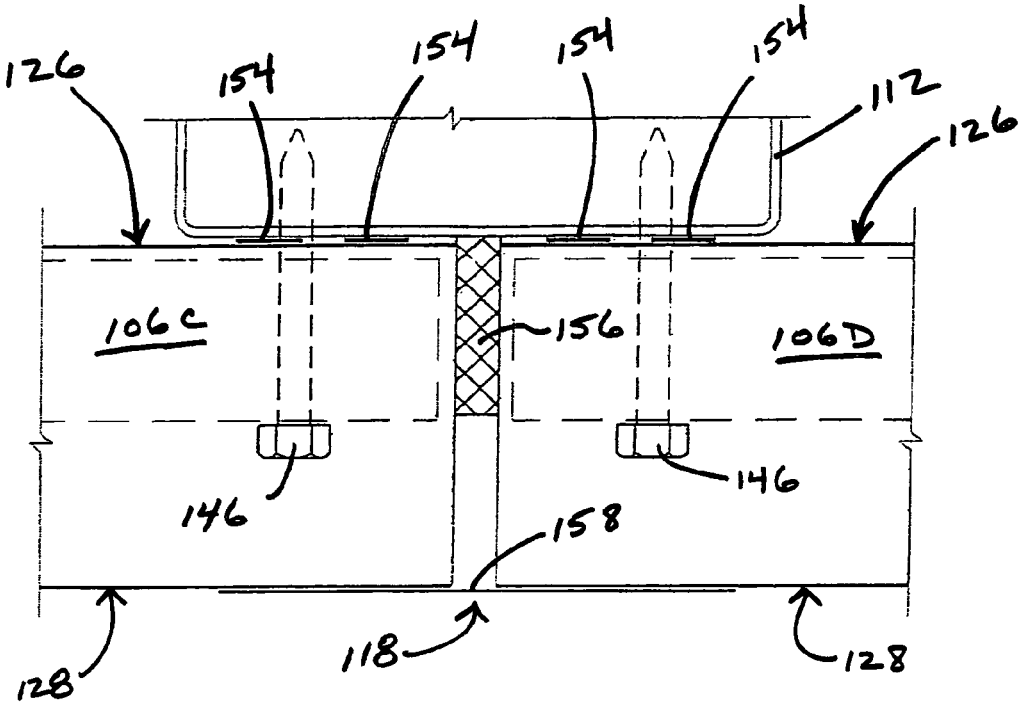
FIG. 8 is a top view of an exemplary vertical joint between side by side barrier panels (in the embodiment where the system is rotated 90°, the illustrated vertical joint becomes a horizontal joint)

FIG. 8 illustrates the vertical joint 118 where two panels 106C, 106D meet. As shown in FIG. 8, the vertical joint 118 is a butt joint. It is preferred that the vertical joints 118 be formed at the vertical supports 112 which make up the wall framing 102. Rows of protective sealant 154 are applied to the vertical supports 112 to provide a seal between the panels 106C, 106D and the vertical supports 112. A sealant 156, which may be in the form of a sealant tape, is provided in the vertical joint 118. A self-adhering butyl flashing tape 158 is provided on the exterior surfaces 128 of the panels 106C, 106D and covers the vertical joint 118 to prevent water and other moisture, as well as other debris, from entering the vertical joint 118.

The exterior facade 108 is typically secured to the barrier panels 106 at their horizontal joints 124 for strength purposes. This is the preferred method of attachment. However, the panels 106 provide structural support for the exterior facade system 108, such that the exterior facade system 108 may be attached to any portion of the panels 106.

Figure 9:
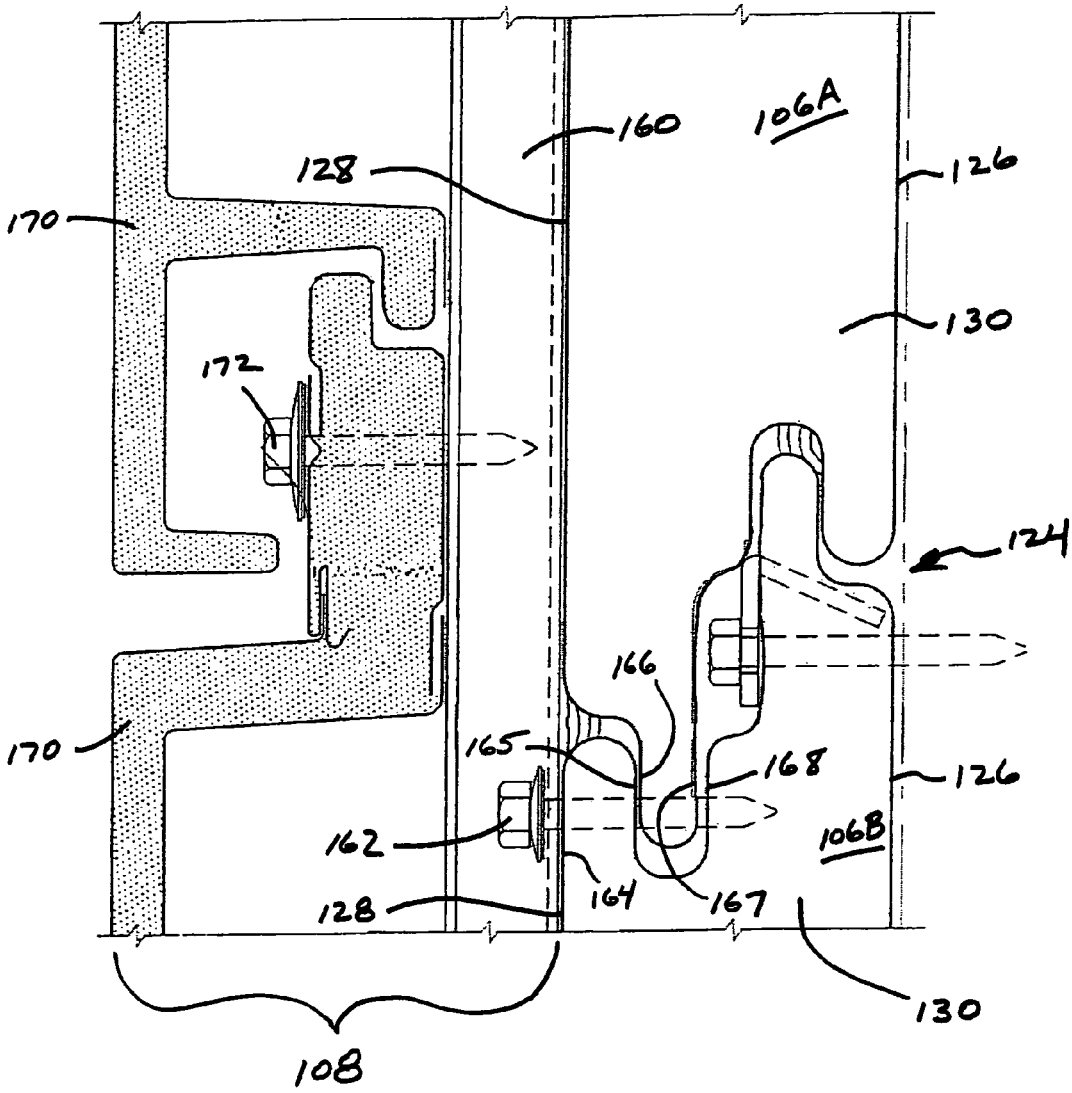
FIG. 9 illustrates connection of an exterior facade system to the barrier panels in accordance with the present invention.

As shown in FIG. 9, in a preferred form, the exterior facade system 108 is attached to the panels 106 at their horizontal joints 124. A vertical, or Z-shaped, subframe 160 is attached to the panels 106 by a fastener 162. The fastener 162 attaches the subframe 160 to the panels 106 at their horizontal joint 124. When attached at the horizontal joint 124, the fastener 162 extends through five layers of galvanized steel 164-168, and thus firmly secures the exterior facade system 108 to the panels 106. Attaching the exterior system 108 to the panels 106 in this manner increases the load capacity of the panels 106 several fold, since it is based on fastening into several layers of steel liners 164-168 at the horizontal joint 124. Since the fastener 162 extends into the foam core 130, but not though the interior sheet 126 of the panels 106, the air and vapor barrier defined by the interior sheets 126 of the panels 106 is not compromised. Exterior panels, shown generally at 170, are then attached to the subframe 160 via conventional fasteners 172.

Any type of exterior panel system may be attached to the subframe 160, and FIG. 9 illustrates one exemplary type of external panel system sold under the trademark FORMA-BOND®. As shown in FIG. 9, such exterior panels 170 will typically have an opening for ventilation should moisture enter between the exterior panels 170 and the barrier panels 106. In this manner, the air, water, vapor and thermal barrier formed by the panels 106 is still maintained, since no fastener extends all of the way through any of the panels 106. The subframe 160 and exterior panels 170 are securely attached to the panels 106, which provide support therefore.

Figure 10:
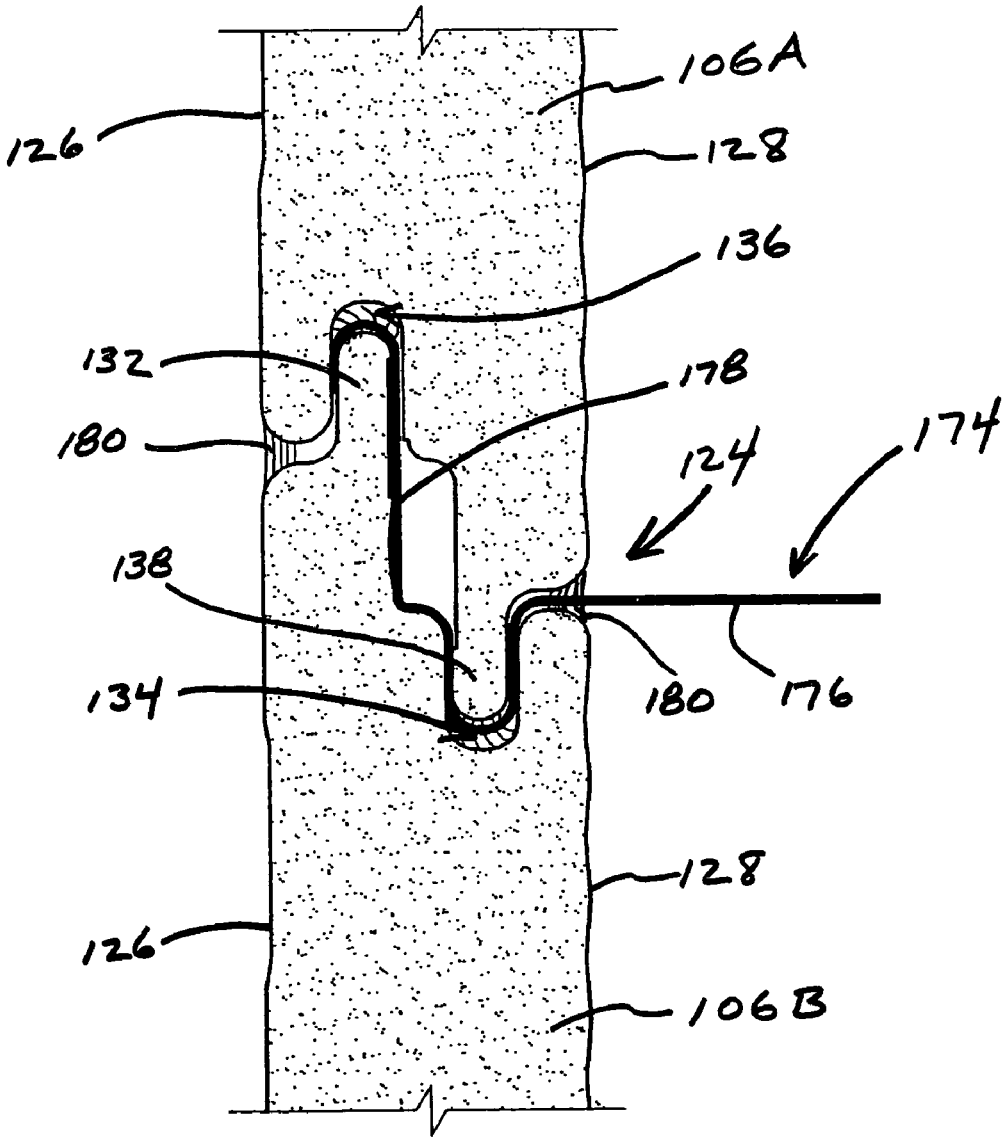
FIG. 10 illustrates connection of a brick tie-in at an exemplary horizontal joint between top and bottom barrier panels for attachment of a brick exterior facade to the barrier panels (in the embodiment where the system is rotated 90°, the illustrated horizontal joint becomes a vertical joint)

As shown in FIG. 10, if a brick exterior is desired, a brick tie, shown at 174, may be implemented at the horizontal joints 124 to support the brick exterior. As shown in FIG. 10, the brick tie 174 includes an outwardly extending portion 176 which attaches to the brick exterior (not shown). The brick tie 174 also includes an inwardly extending portion 178 which extends into, and generally conforms to, the horizontal joint 124, and thus secures the brick tie 174 to the panels 106A, 106B via engagement of the tongues 132, 138 with the female connectors 136, 134, respectively. Since bricks will typically rest on the ground, the brick tie 174 arrangement is designed for lateral support, rather than longitudinal support, of the bricks, which is typically not needed.

In addition to sealant being provided at the female connectors 134, 136, sealant 180 may also be provided at the horizontal joint 124 along both the inner 126 and outer 128 surfaces of the barrier panels 106 to further seal the horizontal joint 124.

Figure 11:
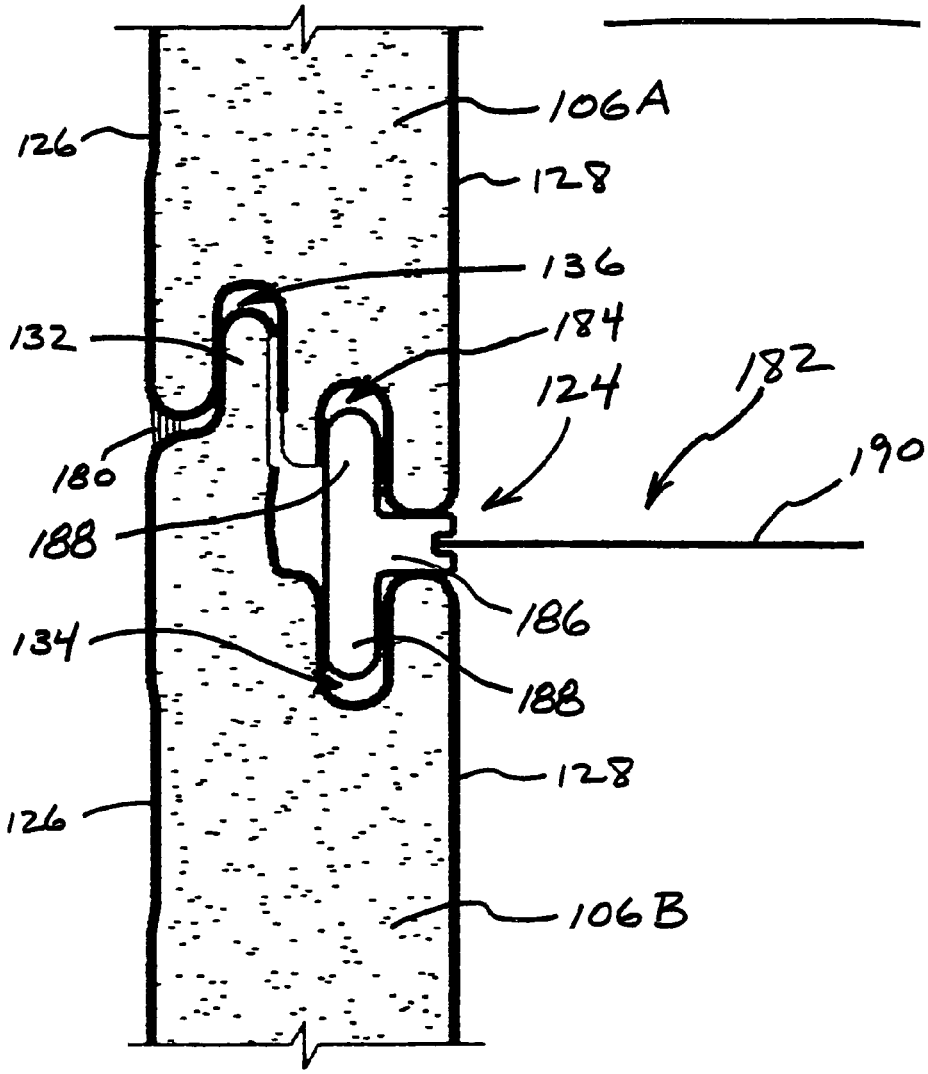
FIG. 11 illustrates connection of an alternate embodiment of a brick tie-in at an exemplary horizontal joint between top and bottom barrier panels for attachment of a brick exterior facade to the barrier panels (in the embodiment where the system is rotated 90°, the illustrated horizontal joint becomes a vertical joint).

FIG. 11 illustrates an alternate embodiment of a brick tie, shown generally at 182, for implementation with the present invention. In order for attachment of the brick tie 182 at the horizontal joint 124, the male connector 138 of the barrier panel 106A is replaced with a female connector 184, as shown in FIG. 11. The brick tie 182 includes a body portion 186 having opposing arms 188 which are received in the female connectors 184 and 134 of the barrier panels 106A and 106B, respectively, thus securing the brick tie 182 to the panels 106A, 106B. An outwardly extending portion 190 extends from the body portion 186 and attaches to the brick exterior (not shown). As previously noted, since bricks will typically rest on the ground, the brick tie 182 arrangement is designed for lateral support, rather than longitudinal support, of the bricks, which is typically not needed. While not shown in FIG. 11, sealant may be provided in the female connectors 134, 136 and 184, as well as at the horizontal joint 124.

The wall framing 102 may be pre-attached to the barrier panels 106 before installation. The wall framing 102 may be pre-attached to one or more barrier panels 106, and then installed in large sections at the building site, rather than installing the wall framing 102 and then the panels 106 separately, typically installing the panels 106 one at a time. In this manner, the necessary wall framing 102 required for a particular application will be designed and attached to the panels 106. Then the panels 106, with attached wall framing 102, are attached to the building structure via conventional connection means. Through such panelization of the system, the building process is accelerated which, in turn, may have significant impact on temporary heat requirements and the minimization of moisture intrusion into the building interior during the construction process.

While the present invention has been described with particular reference to the drawings, it should be understood that various modifications could be made without departing from the spirit and scope of the present invention. For instance, while the barrier panels 106 are shown and described as being connected to the wall framing 102 at their upper side edges 120, the panels 106 may be rotated 180° such that the upper side edge 120 becomes the lower side edge, and the panels 106 connected to the wall framing 102 at that lower side edge without departing from the spirit and scope of the present invention. This orientation has a particular advantage in that water and/or other debris are less likely to enter and be retained in the female connector 134 (see FIG. 10) should the seal 180 be compromised, since in this orientation the female connector 134 would be orientated with the top panel 106 of the joint 124. In this orientation, as well as the orientation described below, the brick tie connector 174 would typically remain the same.

Additionally, the entire system may be rotated 90° such that the horizontal joint 124 described above becomes the vertical joint, and the vertical joint 118 becomes the horizontal joint of the building system without departing from the spirit and scope of the present invention. A detailed discussion of this embodiment is not necessary, since the structure and attachment of the panels 106 remains the same, just rotated 90° so that the described horizontal joints become the vertical joints and the described vertical joints become the horizontal joints. In this embodiment, the exterior facade system 108 (subframe 160 and panels 170) will typically be attached to the panels 106 at their vertical joint for strength purposes, in the preferred manner as previously described. However, the panels 106 provide structural support for the exterior facade system 108 such that the exterior facade system 108 may be attached to the panels 106 at any portion thereof.

I claim:

1. A building envelope system for providing an air, water, vapor and thermal barrier about a building structure, the building envelope system comprising:

framing structurally connected to the building structure;

an exterior façade system; and first and second barrier panels attached to an outer face of the framing and providing an air, water, vapor and thermal barrier about the building structure, each barrier panel comprising:

a structural foam core; and inner and outer facing sheets provided about the structural foam core, wherein a joint is formed by the first and second barrier panels, and wherein the exterior façade system is attached to the first and second barrier panels via a fastener extending through the outer facing sheets of each barrier panel at the joint such that the air, water, vapor and thermal barrier defined by the at least one barrier panel is maintained.

2. The building envelope system of claim 1, wherein the outer face of one each barrier panel is striated or planked.

3. The building envelope system of claim 1, wherein the first barrier panel includes male and female connectors on a lower edge thereof, and wherein the second barrier panel includes cooperating female and male connectors on an upper edge thereof, the male and female connectors of the first barrier panel connected to the cooperating female and male connectors of the second barrier panel to form the joint.

4. The building envelope system of claim 1, wherein the inner and outer facing sheets of each barrier panel comprise galvanized steel or aluminum.

5. The building envelope system of claim 1, wherein the structural foam core of each barrier panel comprises a foam material selected from the group consisting of polyurethane, poly-isocyanurate, phenolic foam and mineral wool.

6. A method of constructing a building wall comprising:

designing framing for attachment to a building structure;

attaching two or more barrier panels to the framing, the two or more barrier panels forming a joint and providing an air, water, vapor and thermal barrier about the building structure;

attaching the framing, with the two or more barrier panels attached, to the building structure; and attaching an exterior façade system to the two or more barrier panels by positioning a fastener through an outer face of each barrier panel at the joint such that the air, water, vapor and thermal barrier defined by the two or more barrier panels is maintained.

7. The method of claim 6, wherein the two or more barrier panels each comprise:

a structural foam core; and inner and outer facing sheets provided about the structural foam core.

8. The method of claim 7, wherein the outer face of the two or more barrier panels is striated or planked.

9. The method of claim 7, wherein the structural foam core comprises a foam material selected from the group consisting of polyurethane, poly-isocyanurate, phenolic foam and mineral wool, and wherein the inner and outer facing sheets comprise galvanized steel or aluminum.

10. The method of claim 6, wherein the two or more barrier panels comprise upper and lower barrier panels forming the joint.

11. The method of claim 10, wherein the upper barrier panel includes male and female connectors on a lower edge thereof, and wherein the lower barrier panel includes cooperating female and male connectors on an upper edge thereof, the male and female connectors of the upper barrier panel connected to the cooperating female and male connectors of the lower barrier panel to form the joint.

12. The method of claim 6, wherein the two or more barrier panels comprise left and right barrier panels forming the joint.

13. A building panel envelope system comprising:

upper and lower barrier panels each having inner and outer facing sheets and a structural foam core positioned between the inner and outer facing sheets; and an exterior façade system, wherein a horizontal joint is defined by the upper and lower barrier panels, the exterior façade system being secured to at least one of the outer facing sheets of the upper and lower barrier panels via a fastener extending only partially into the structural foam core at a position adjacent to the horizontal joint.

14. A building panel envelope system comprising:

upper and lower barrier panels each having inner and outer facing sheets and a structural foam core positioned between the inner and outer facing sheets; and an exterior façade system, wherein a horizontal joint is defined by the upper and lower barrier panels, the exterior façade system being secured to at least one of the outer facing sheets of the upper and lower barrier panels via a fastener arranged within the horizontal joint.

* * * * *

UNITED STATES PATENT AND TRADEMARK OFFICE

CERTIFICATE OF CORRECTION

PATENT NO. : 7,748,181 B1
APPLICATION NO. : 11/654181
DATED : July 6, 2010
INVENTOR(S) : Guinn It is certified that error appears in the above-identified patent and that said Letters Patent is hereby corrected as shown below:

Column 7, line 42, Claim 2, "of one each barrier" should read -- of each barrier --

Signed and Sealed this

Ninth Day of November, 2010

David J. Kappos

David J. Kappos
*Director of the United States Patent and Trademark Office*